United States Patent [19]

Martin

[11] Patent Number: 4,516,880

[45] Date of Patent: May 14, 1985

[54] UNDERWATER TRENCHING APPARATUS

[76] Inventor: Charles F. Martin, P.O. Box 197, Porter, Tex. 77365

[21] Appl. No.: 369,488

[22] Filed: Apr. 19, 1982

[51] Int. Cl.[3] ..... F16L 1/04; E02F 5/02

[52] U.S. Cl. ..... 405/160; 405/162; 405/163

[58] Field of Search ..... 405/158–163, 405/166; 294/115; 414/747; 37/56, 62, 63, 72

[56] References Cited

U.S. PATENT DOCUMENTS

| | | | |
|---|---|---|---|
| 3,717,003 | 2/1973 | Bates, Jr. et al. | 405/162 |
| 3,877,237 | 4/1975 | Norman | 405/160 |
| 3,926,003 | 12/1975 | Norman | 405/162 |
| 4,022,028 | 5/1977 | Martin | 405/159 |
| 4,030,625 | 6/1977 | Koehnen | 294/115 |
| 4,037,422 | 7/1977 | de Boer et al. | 405/160 |
| 4,117,689 | 10/1978 | Martin | 37/63 |
| 4,190,382 | 2/1980 | Schmitz et al. | 405/159 |
| 4,274,760 | 6/1981 | Norman | 405/160 |
| 4,280,289 | 7/1981 | Bassompierre-Sewrin | 405/160 |

FOREIGN PATENT DOCUMENTS

| | | | |
|---|---|---|---|
| 2145757 | 3/1972 | Fed. Rep. of Germany | 37/63 |
| 2145758 | 3/1972 | Fed. Rep. of Germany | 37/63 |

*Primary Examiner*—David H. Corbin

*Attorney, Agent, or Firm*—Gunn, Lee & Jackson

[57] ABSTRACT

A trenching machine for digging a trench beneath a pipeline lying on the floor of a body of water, with a pair of laterally spaced vertical cutting members, shown to be a series of water jets, positioned at each end of the machine. The cutting members are laterally adjustable to move apart and tilt with respect to the vertical centerline of the machine. The cutting members are also arranged to oscillate about a vertical axis. Fore and aft side rollers are longitudinally spaced under the framework of the machine and are arranged to contact the pipeline to drive the machine along the pipeline and to stabilize the machine in its upright operating position over the pipeline. The rollers have selectively adjustable hydraulic biasing cylinders associated with each set of rollers to maintain a constant gripping force between the rollers and pipeline. The rollers are selectively reversibly driven to provide back and forth operation of the trenching machine. The driving torque applied to each set of rollers is also variable from a remote location. A weight control system maintains the machine at a constant loading weight on the pipeline, using a combination of a floatation vessel adapted to have longitudinal tilt control, and fore and aft upper rollers, each having regulation devices for maintaining a selectively adjustable force between the floatation vessel and its attached frame and the pipeline. Lateral thrusters mounted on the floatation vessel provide lateral balance to the machine as it moves along the pipeline.

20 Claims, 11 Drawing Figures

FIG. 7
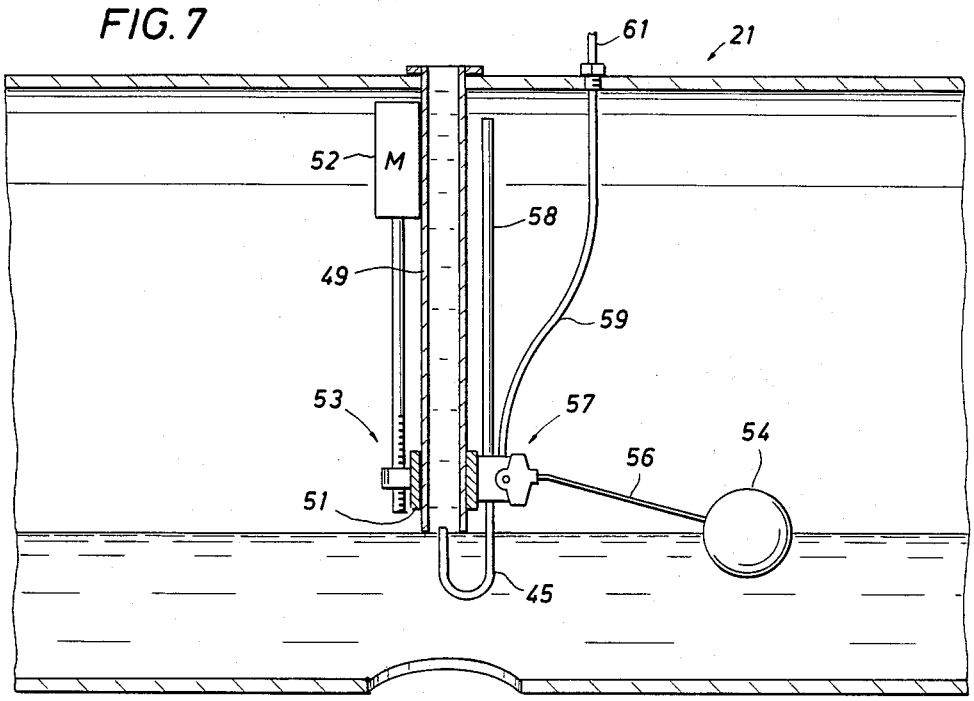
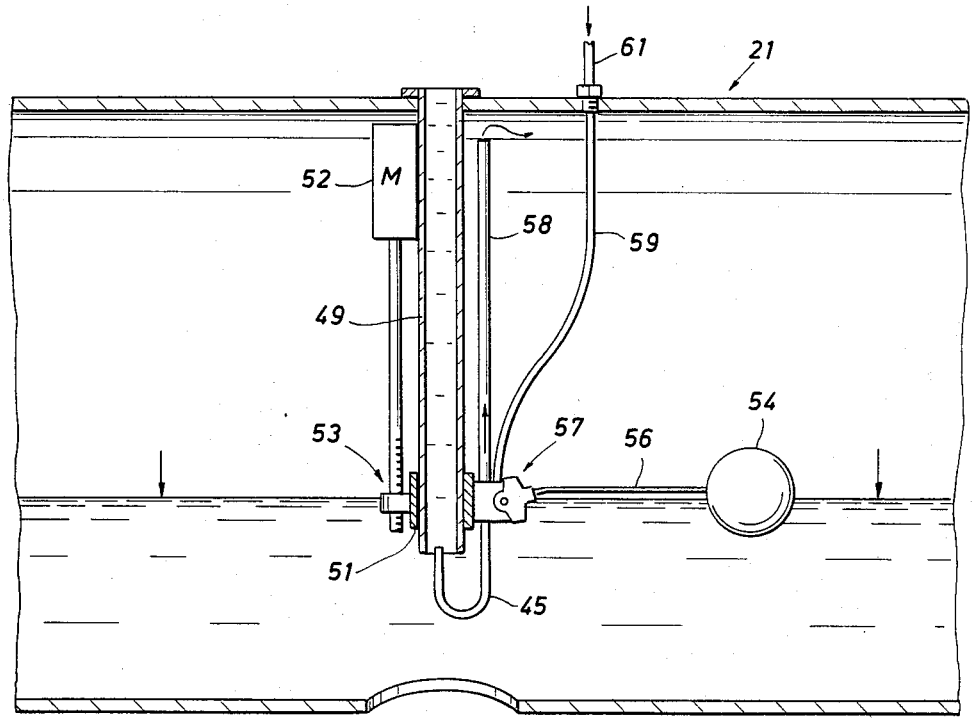
FIG. 8

UNDERWATER TRENCHING APPARATUS

BACKGROUND OF THE INVENTION

The present invention relates to an underwater trenching apparatus and more particularly to a self propelled trenching apparatus for movement along a pipe lying on the bottom of a body of water to excavate a trench under the pipe.

Such trenching machines are shown in U.S. Pat. Nos. 3,429,131; 3,429,132; 3,717,003; 4,022,028; and 4,274,760. Typical of the background problems associated with such equipment are the devices shown in U.S. Pat. Nos. 3,717,003 and 4,274,760.

Bates Jr. et al. patent (U.S. Pat. No. 3,717,003) shows a trenching apparatus for use in operations similar to that of the present invention wherein a pair of rotatable cutter heads is supported by a carriage which is positioned on a pipeline to be buried. The cutters are arranged to dig a trench beneath the pipeline over which the carriage moves, whereby upon removal of the cuttings from the trench, the trailing portion of the pipeline is free to fall into the trench. A suction conduit is positioned adjacent to the cutters to suction cuttings from the vicinity of the trench. Two separate driving wheels are positioned on top of the pipe and an idler wheel is positioned beneath the pipe and urged upwardly against the pipe by a yieldable force which clamps the pipeline between it and the upper wheels. Both upper and lower wheels are positioned behind the trench cutters and behind the longitudinal center of the carriage. Fore and aft buoyancy tanks are used to reduce the load or weight of the apparatus on the pipeline. One set of rollers having four individual rollers mounted on top, below and on each side of the pipeline limit movement of the carriage in any direction laterally with respect to the pipeline. These rollers are not urged into gripping contact with the pipeline. The arrangement described above is not rotationally stable about the pipeline for a number of reasons. For example, the wheels driving the apparatus along the pipeline are positioned behind the center of the carriage tending to facilitate a longitudinal tilt of the carriage. Also, there is not sufficient control of the buoyancy tanks to balance the load of the carriage on the pipeline under varying conditions of water depth, pipeline diameter variations, tilt of the pipeline itself, etc. These conditions and others permit the carriage to lift from the pipeline and thus drive off laterally from the pipeline. This in turn causes the carriage to rotate about the longitudinal axis of the pipeline.

Norman patent (U.S. Pat. No. 4,274,760) shows a trenching device having a roller driving system designed to avoid the use of divers in moving the apparatus past obstructions on the pipeline, such as anodic collars positioned about the pipeline at spaced locations. Norman shows the use of fore and aft driving side rollers which are urged into contact with the pipeline but which are selectively disengageable in pairs from contact with the pipeline to permit passage of the rollers over an obstruction. Upon passage of the leading pair of rollers over an obstruction, the leading pair of rollers are closed on the pipe and the trailing pair of rollers are opened from engagement with the pipe until their passage past the obstruction whereupon the trailing pair of rollers are re-engaged with the pipe. The above-described operation is cumbersome and time consuming. The frame structure of the Norman device is constructed so that the rollers, when pushed outwardly from the pipeline, pivot radially about the top of the carriage, bending the carriage frame longitudinally. The arrangement of supports for the rollers including the disengaging mechanism provides a parallelogram structure which misaligns itself on the pipeline under certain operating conditions. In addition, control of buoyancy tanks is limited so that variations in water depth as well as other variable factors, including roller disengagement and eccentric forces resulting therefrom cause the carriage to shift on the pipeline to the detriment of the trenching operation.

Additionally, none of the above-referenced patents show an apparatus which can be moved back and forth along the pipeline to facilitate variable depth entrenchment.

It is therefore an object of the present invention to provide a new and improved trenching system for stable movement and weight control on a pipeline to facilitate accurate and trouble-free operations and a system which can be operated in either direction to facilitate variable depth entrenchment.

SUMMARY OF THE INVENTION

With this and other objects in view the present invention contemplates a trenching apparatus for movement along a pipeline lying on the bottom of a body of water. A frame is movably carried on the pipeline by means of powdered rollers which have biasing mechanisms to constantly urge the rollers into contact with the pipeline. Some form of earth cutters are carried by the frame to excavate a trench under the pipeline as the apparatus is driven along the pipeline.

In one aspect of the invention, fore and aft sets of powered rollers are positioned on the pipeline to propel the frame on the pipeline. A single biasing member is associated with each set of rollers and a mechanism is provided whereby the biasing member associated with each set of rollers may be independently adjusted to provide a variation in biasing force between the sets of rollers. A linkage between the rollers in each set of rollers and the single biasing member is arranged so that the rollers in each set can only move toward or away from one another simultaneously.

In still another aspect of the invention, the fore and aft driving rollers are remotely, selectively, reversibly driven.

Yet another feature of the invention involves the use of a weight control system wherein a flotation tank has selectively adjustable means for varying the water level in the tank and thus the weight applied by the apparatus frame to the pipeline.

Water is maintained at a predetermined selected level in the tank by an air pressure inlet valve into the tank which is in turn operated automatically by a liquid level sensor.

Another aspect of the invention involves the use of thrusters to provide lateral forces and thus control roll of the frame about the pipeline.

Additionally, the floatation tank has air vents at its opposite ends to prevent inadvertent longitudinal tipping of the tank above a fixed limit.

BRIEF DESCRIPTION OF THE DRAWINGS

FIGS. 7 and 8 are partial cross-sectional schematic views of the weight control tank showing the water level sensor and air supply for maintaining a constant water level in the tank;

DETAILED DESCRIPTION OF THE DRAWINGS

Figure 1:
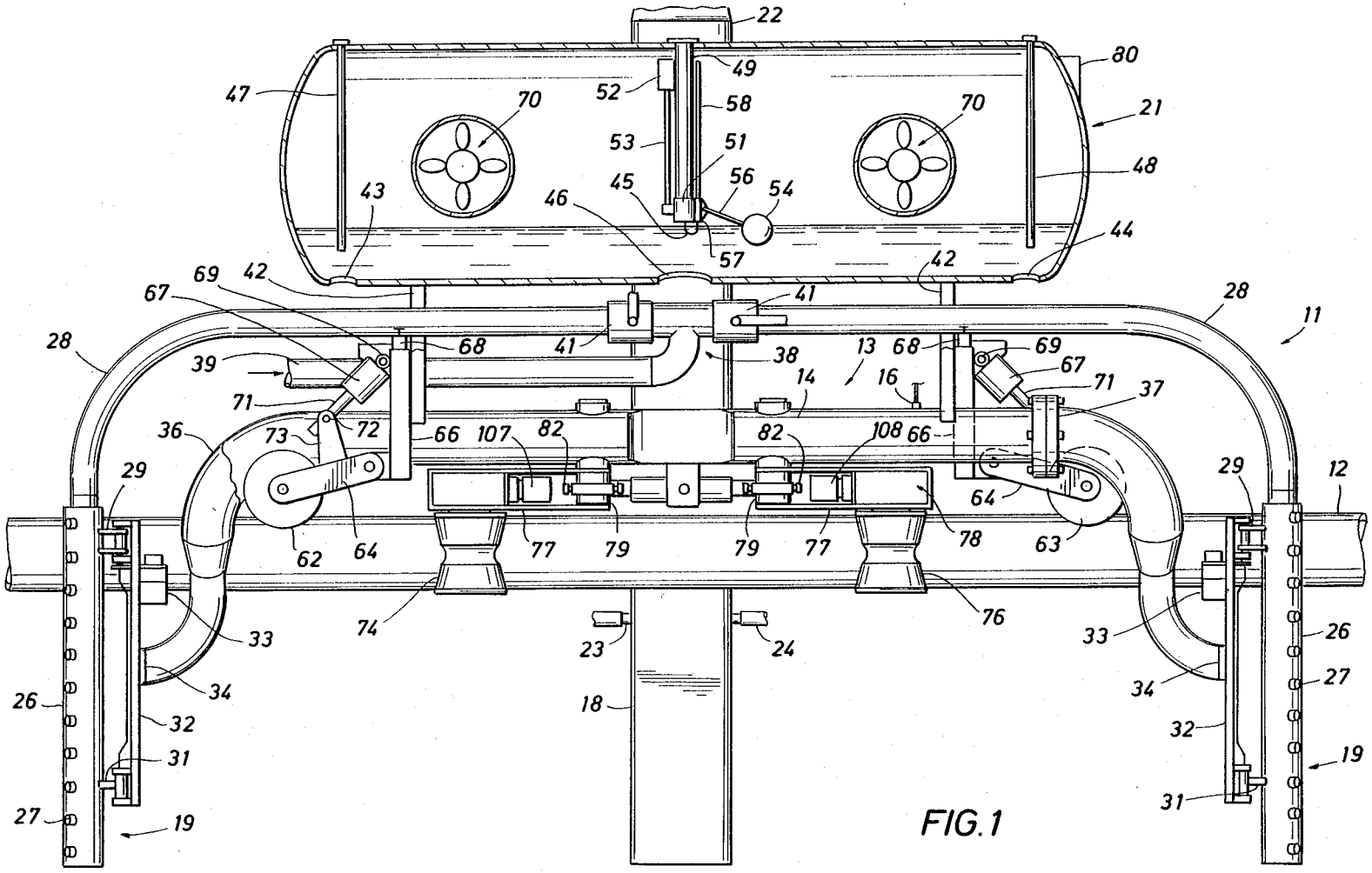
FIG. 1 is a side elevation cross-sectional view of the trenching apparatus of the present invention shown positioned on a pipeline.

Referring first to FIG. 1 of the drawings, a trenching machine 11 for operation along a pipeline 12 is shown having a frame 13 for mounting various components of the machine. The frame 13 is constructed of a parallel pair of tubular members 14 which serve as an air reservoir and are connected by means of a filler valve 16 to an air supply extending to the surface. A lateral tubular connecting member 17 (FIG. 2) extends between the parallel tubular members 14 to connect the frame 13 and provide communication between otherwise separated portions of the air reservoir. A surface vessel or platform (not shown) is positioned on the water surface above the trenching machine to provide operating support to the trenching machine such as the air supply mentioned above. A pair of vertical eductor tubes 18 are attached to the frame 13 and extend from a lower level even with the bottom of trench cutters 19, upwardly to a level above a weight control tank 21. The upper end 22 of the educator tubes flare outwardly laterally of the machine (FIG. 4) to eductor trenched material outwardly away from the trenching operation. Extension tubes (not shown) are connected to the ends 22 to move the excavated material even further outwardly from the operation. Air inlet tubes 23 are shown positioned on opposite sides of eductor 18 below the pipeline 12. Hoses 24 connect the eductors with a high volume supply of air under relatively high pressure to air lift excavated material being cut from the sea floor by cutters 19 when the machine progresses along the pipe 12 as will be further described.

The cutters 19 are comprised of vertical tubular members or jet heads 26 which have an array of jet nozzles 27 arranged on the outer surface thereof. The upper end of tubular member 26 is connected to a hose or conduit 28 for supplying water under pressure to the jet head 26. The jet head 26 is connected by upper and lower rotatable arms 29 and 31 respectively to a jet head support member 32. A hydraulically operated motor 33 is mounted on the support member 32 and is connected to the rotatable arms 29 to move the jet heads in a back and forth oscillating path for excavating earth materials adjacent the path of the jet heads. As the earth materials are loosened by the action of water jetting from nozzles 27 in an oscillating path, the trailing eductors 18 having an air lift operating therein, suction up the materials and move them to an exit point laterally spaced from the trenching operation.

Figure 4:
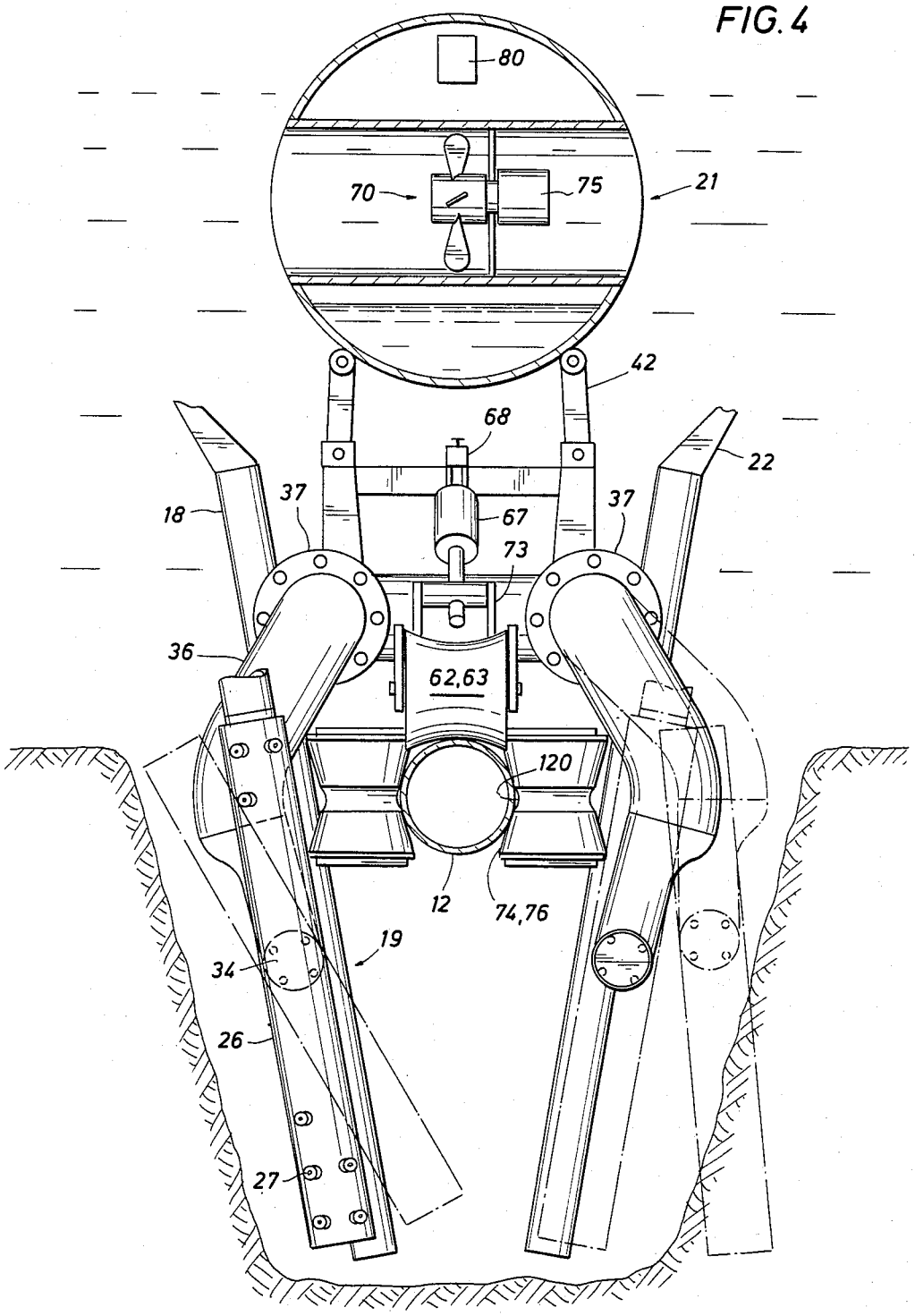
FIG. 4 is an end elevational view of the trenching apparatus shown digging a trench in the floor of a body of water and in particular illustrating the adjustable features associated with the digging apparatus as mounted on the frame.

The jet head support member 32 is adjustably mounted for tilt with respect to a vertical axis by means of a flange assembly or connection 34 (shown in greater detail in FIGS. 9 and 10) between the support member 32 and jet head extension and positioning arm 36. Positioning arm 36 is also connected by means of an adjustable flanged connection 37 (see right side of FIG. 1 and FIG. 11) to the tubular frame members 14. As shown in FIGS. 1 and 4, there are two sets of two jet heads and associated apparatus mounted fore and aft on the trenching machine 11. The conduits 28 for supplying water under pressure to fore and aft jet heads 26 are connected by means of a bidirectional T fitting 38 to a high pressure water supply hose 39. Selectively operable butterfly valves 41 are positioned on the T fitting to alternatively admit water from the water supply hose 39 to the fore and aft conduits 28 as will be hereinafter described. Remote means (not shown) are located on the surface platform or vessel to operate the valves 41.

Vertical support members 42, which are connected at their lower ends to frame members 14, are arranged to support weight control tank 21. Tank 21 is an elongated vessel having fore and aft lower openings 43, 44 respectively as well as a lower center opening 46 for communicating water between the exterior and the interior of the tank when the tank is positioned below the surface of a body of water. The tank is additionally provided with fore and aft vent lines or conduits 47, 48 respectively connecting the interior of the tank below a certain level with the exterior of the tank for purposes to be hereinafter described. Near the center of the tank 21, a vertical tube 49 extends from the outer surface of the tank to a predetermined fixed point near the bottom of the tank. A collar 51 is shown slidably mounted about the tube 49 and arranged for vertical movement up and down the tube 49. A reversible motor 52 and screw drive mechanism 53 are mounted on the tube and serve to slide the collar 51 up and down relative to the tube 49. A remote control 50 (FIG. 3) is provided at the surface for raising or lowering the collar 51 and attached float 54 to provide the capability of remotely controlling the weight of the trenching machine on the pipe 12. A float 54 is shown connected by means of a float arm 56 to a dual purpose valve 57 mounted on the collar 51 (see FIGS. 7 and 8 for greater detail). The dual purpose valve 57 has an air inlet tube 58 which extends upwardly from the valve 57 to a point near the top of the inside of the tank. The valve 57 in one mode is connected to an air inlet tube 59 (FIGS. 7 and 8) which extends to a source of high pressure air 61 external of the tank 21. Thus, as the float 54 moves up, air is admitted from air source 61 through valve 57 into tube 58. Conversely, if the float moves down past a certain limiting point, the valve 57 opens the tube 58 into communication with "J" tube 45 which permits air to be displaced from the inside of tank 21. The tank 21 thus provides a weight control system for limiting the amount of weight with which the trenching machine rides on the pipe 12. This vertical weight load is carried primarily between the machine frame 13 and the pipe 12 by means of fore and aft top rollers 62 and 63 respectively. The rollers 62 and 63 are rotatably carried on top roller arms 64 which in turn are pivotedly connected to depending vertical roller support members 66 which are connected to frame members 14. Also mounted on the support members 66 are air operated, air over oil type biasing cylinders 67 which maintain a constant biasing force between the frame 13 and the top rollers riding on pipe 12. Valves 68, associated with each of the cylinders 67, provide a means for adjusting the biasing force applied by the cylinders to the rollers 62 and 63 respectively. The cylinders 67 are pivotally mounted to support members 66 by pins 69. Pistons 71 extending from the cylinders 67 are pivotally connected at 72 to vertical roller arms 73. Vertical roller arms 73 are fixedly connected to top roller arms 64 to provide a connecting link between the extendible pistons 71 and the fore and aft rollers 62 and 63 respectively.

Figure 2:
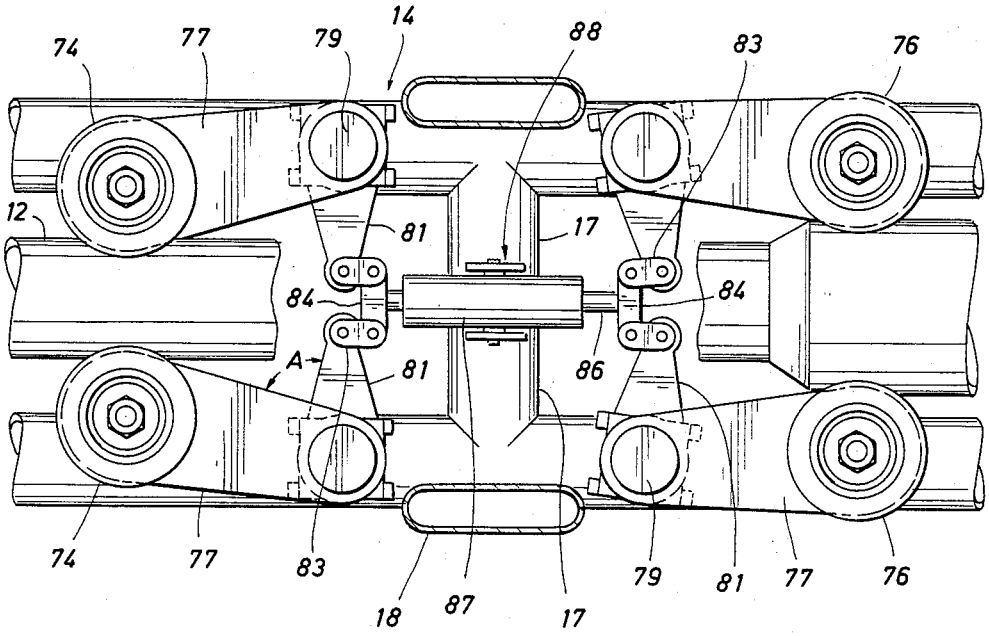
FIG. 2 is a partial plan view of a lower portion of the trenching apparatus of FIG. 1 showing fore and aft sets of driving rollers engaging a pipeline having a variation in its external diameter and a selectively operable constant biasing apparatus associated with the sets of rollers.

FIG. 1 also shows a side elevational view of an arrangement of fore and aft driving rollers 74, 76 respectively and their associated apparatus for driving the trenching machine along the pipe 12. Referring now to FIGS. 1 and 2, the driving rollers 74, 76 are arranged in pairs of rollers which contact pipe 12 directly opposite one another. The rollers are supported for driving engagement with pipe 12 by roller arm brackets 77 which support the driving motor assembly 78 associated with each of the driving rollers. Arm brackets 77 are fixedly connected to trunnion mounts 79. Trunnion mounts 79 extend upwardly through and are fixed to the frame members 14. An adjustable torque arm 81 is clamped to each of the trunnion mounts 79 by means of clamp bolts 82. Clamp bolts 82 permit the torque arm 81 to be loosened on the trunnion mount 79 and rotated relative thereto to permit adjustment of the angle A (FIG. 2) between the bracket 77 and torque arm 81. The bolts 82 are then tightened to maintain a rigid connection between the torque arm 81 and trunnion mount 79. A centering linkage 83 which is pivotally connected at one end to the torque arm, is likewise pivotally connected at its other end with piston head 84. Piston head 84 is mounted on piston rod 86 which extends outwardly from the back to back cylinder housing 87. Cylinder housing 87 is trunnion mounted on the frame connecting tube 17 by a pivotal mount 88.

Figure 3:
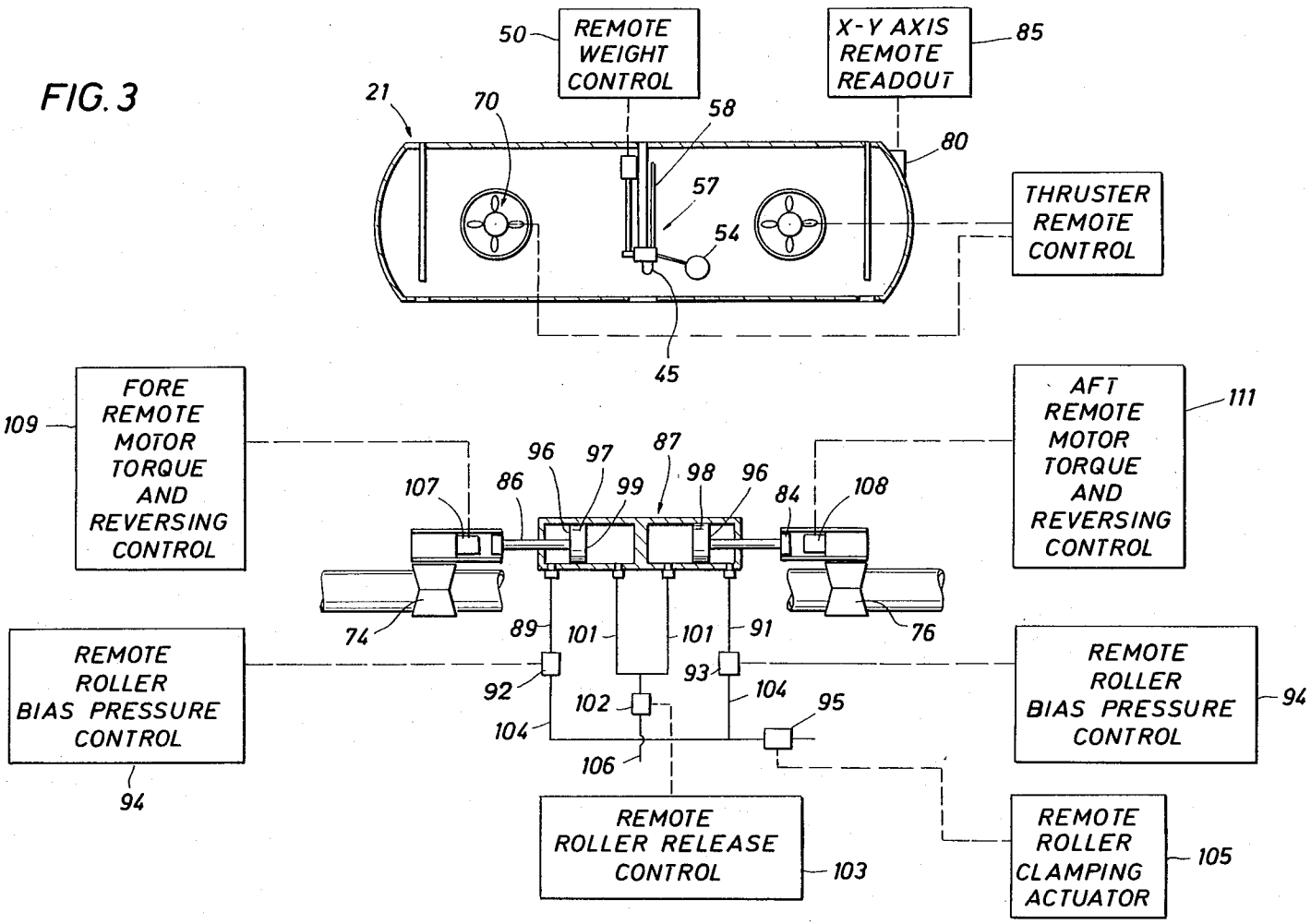
FIG. 3 is a schematic diagram of the various remotely controlled systems associated with the trenching apparatus including the biasing apparatus of FIG. 2 and the hydraulic system associated therewith.

As illustrated schematically in FIG. 3 of the drawings, hydraulic pressure is supplied to each end of the cylinder housing 87 by fore and aft pressure lines 89, 91 corresponding to the hydraulic biasing mechanism associated with the fore and aft rollers 74, 76 of FIG. 2. The fluid pressure lines are passed through fore and aft regulators 92, 93 which are selectively adjustable pressure relief valves or sequence valves that operate to vent pressure above a certain limit between say 150 to 500 PSI. Each of these valves 92, 93 is remotely operable from the surface by a remote surface control 94. The pressure entering the lines 89, 91 impinges on the outer piston wall 96 of fore and aft pistons 97, 98 respectively. This causes the piston rods 86 to move inwardly and thereby urge the fore and aft rollers 74, 76 against the pipe 12. Since the sequence valves 92, 93 are operable remotely, the biasing force between fore and aft rollers can be varied. This may be important for any number of reasons such as to facilitate the remotely controlled backward and forward movement of the trenching machine on the pipe 12 as will hereinafter be described. At the inward side 99 of each pistons 97, 98, the cylinder 87 is connected by fluid lines 101 to a motor valve 102 which in turn is remotely operable by remote roller release control 103. By opening valve 102, hydraulic pressure is applied simultaneously to the inner side 99 of both pistons 97, 98 to move both the fore and aft sets of rollers 74, 76 away from the pipe 12. Fluid supply lines 104 to each of the valves 92, 93 supply hydraulic fluid under pressure to the biasing side 96 of the pistons 97, 98. Fluid supply line 106 supplies hydraulic fluid under pressure to the valve 102 to pressure up the roller release side 99 of both pistons 97, 98 simultaneously. FIG. 3 also shows schematically the operational controls for selectively operating the torque and reversing controls on the rollers 74, 76. The fore and aft rollers 74, 76 have torque motors 107, 108 drivingly connected to each of the individual rollers. These hydraulic motors 107, 108 may be selectively controlled by means of sequence valves which permit the application of a variable pressure to the hydraulic motors. Each fore and aft set of roller motors 107, 108 has such a valve control which is remotely controlled by either the fore or aft remote motor torque and reversing control 109, 111. These control systems also serve as a means to reverse the operational direction of rollers 74, 76 to render the trenching machine movable in back and forth directions on the pipe 12. Also shown in FIGS. 1 and 3 are fore and aft lateral thrusters 70 which are positioned within tubular cylinders formed laterally through the tank 21. Reversible hydraulic motors 75 (FIG. 4) on each of the thrusters operate the thruster fans 70 to provide for lateral roll control of the trenching machine about the pipe 12. A roll detector 80 mounted on the tank 121 is connected by suitable means to a remote x-y axis readout 85 to provide an indication of the vertical orientation of the trencher at a remote location so that the thrusters and other remotely controlled systems may be used to correct such orientation.

Figure 5:
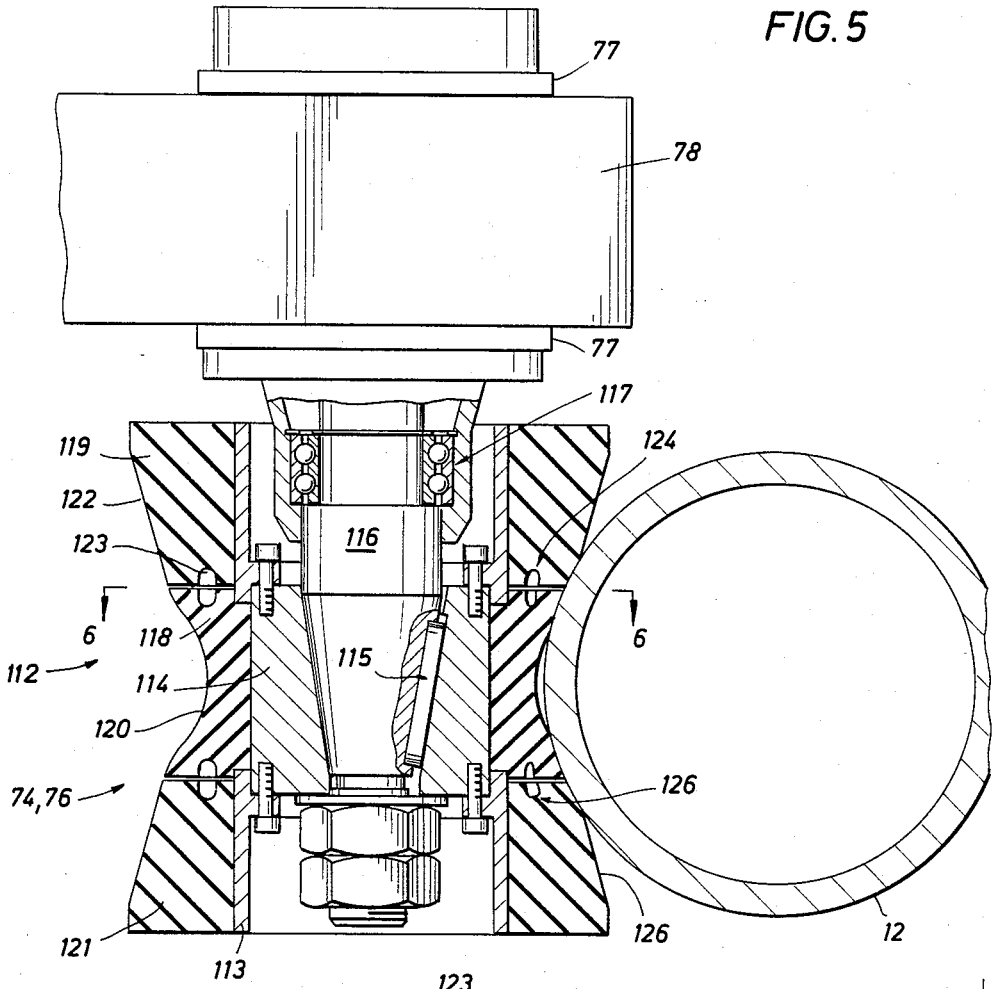
FIG. 5 is a detailed cross-sectional elevational view of a driving roller in contact with a pipe.
Figure 6:
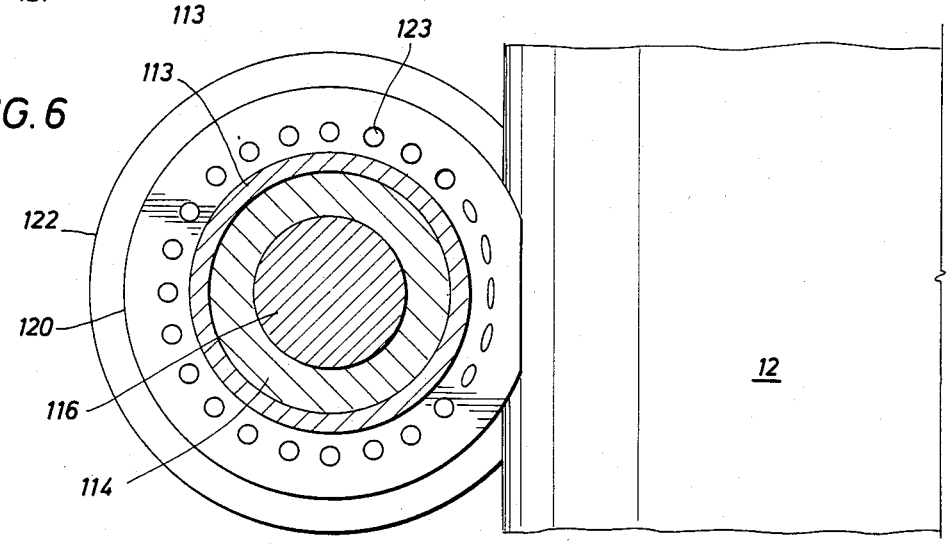
FIG. 6 is a cross-sectional view of the roller taken along lines 6—6 of FIG. 5.

Next referring to FIGS. 5 and 6 of the drawings, the driving rollers 74, 76 are shown in detail as having an outer traction member constructed of a deformable and wear resistant material such as seventy five durometer polyurethane. The traction member assembly 112 is bonded to a mounting hub 113 which in turn is bolted to a roller wheel 114. The wheel 114 is mounted by means of a key and keyway arrangement 115 to a drive axle 116. The drive axle 116 is supported on the frame 13 by a bearing mount 117. The drive axle is connected to the respective torque drive and reversing motors 107, 108.

The traction member assembly 112 is shown constructed in three vertical segments, which when assembled on the hub 113, provide a roller configuration that has a middle segment 118 with a longitudinally concave surface 120 on its outer wall. Top and bottom segments 119, 121 respectively of the traction member assembly 112 have sloped surfaces 122 which converge inwardly toward the concave surface 120 of the middle segment 118. Voids 123 are formed in the inward facing horizontal surfaces of the top and bottom segments 119, 121 and on both the top and bottom horizontal surfaces of middle segment 118, and are so arranged that when assembled, the voids on the top and bottom and middle segments are mated to form an upper and lower annular set of voids 124, 126 which are radially spaced from one another within the wall of the traction element assembly 112.

As shown in FIGS. 5 and 6 when the traction rollers are urged against the pipe 12, the voids in the traction element assembly 112 permit a more pronounced deformation of the assembly 112 at the top and bottom portions of the concave segment 118 of the assembly 112 and thus the "foot print" of the rollers 74, 76 on the pipe is substantially increased as biasing pressure is applied to the rollers 74, 76. This deforming capability of the rollers is also helpful to accommodate variations in the diameter of the pipe being entrenched, as well as anomalies on the pipe creating variations in diameter.

Figure 9:
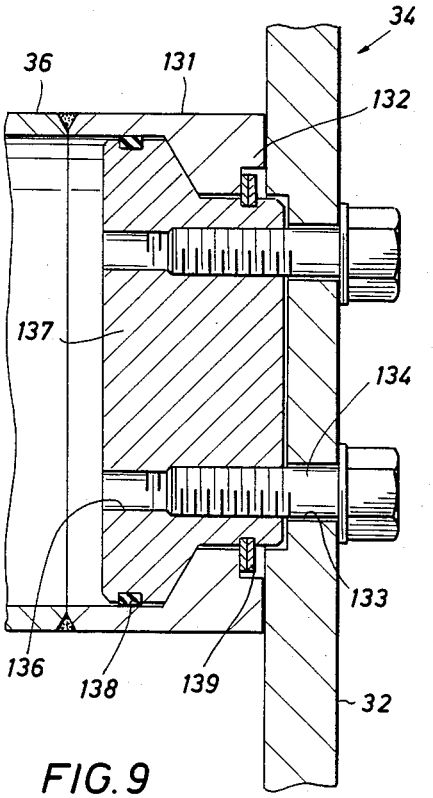
FIG. 9 is a detailed cross-sectional elevation view of a tilt adjusting flange for varying the tilt of the trench cutting members.
Figure 10:
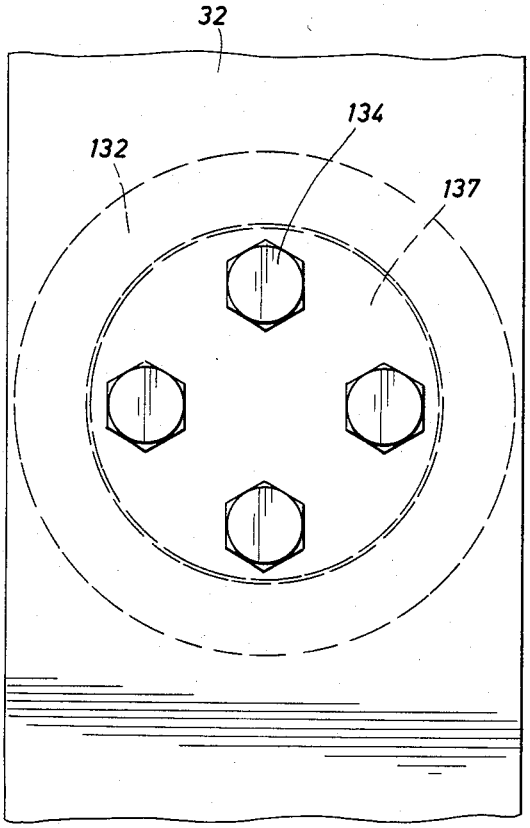
FIG. 10 is an end view of the flange of FIG. 9.

FIGS. 9 and 10 of the drawings show a flanged assembly 34 for attaching the jet heads 26 and their associated mounting apparatus to the frame assembly 113 in such a manner as to accommodate their convenient adjustment in a vertical plane perpendicular to the pipe 12. An inner cylindrical portion 131 of the flange 34 is attached by welding or the like to the circuitous jet head extension and positioning arm 36. The cylindrical portion 131 has an enlarged outer flange portion 132 against which is shown assembled the jet head clamp 32. Holes 133 in the clamp 32 provide a means to insert bolts 134 which are threadedly received within the threaded bores 136 of a rotation sleeve 137 positioned in the bore of cylindrical member 131. Annular seals 138, 139 seal the flange assembly 34 against the influx of water into the cylindrical arm 36. This flange arrangement permits the adjustment from the vertical of the jet heads by loosening the four bolts 134 and then rotating the clamp 32 and sleeve 137 until the jet heads 26 are at a desired tilt whereupon the bolts are tightened to fix the jet heads 26 in such tilted position (see FIG. 4).

Figure 11:
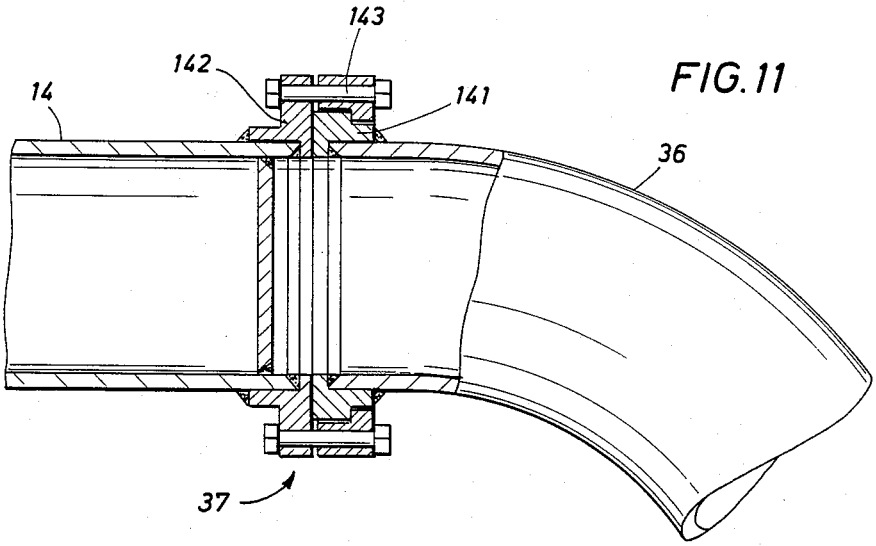
FIG. 11 is a partial cross-sectional view of an adjusting flange for varying the lateral spacing between trench cutting members.

FIG. 11 shows a flange assembly 37 for connecting the jet head extension and positioning arm 36 to the frame members 14. The positioning arm 36 has an exterior shoulder portion 141 attached annularly to its inner end. The cylindrical frame member 14 likewise has an annular shoulder portion 142 formed at its outer ends. Longitudinal bolt holes are provided in each of the shoulder portions 141, 142 so that when such bolt holes are aligned, bolts 143 may be inserted therein to clamp the positioning arm 36 to the frame member 14. This flange arrangement permits convenient rotational adjustment of the positioning arm 36 relative to the frame 13 by loosening the bolts 143, then rotating the positioning arm to a desired position, and tightening the bolts to fix the arm 36 in such a desired position (see FIG. 5). Such convenient rotational adjustment of the flange assemblies 34 and 37 is particularly important when adjustment is being made underwater by a diver.

For describing the operation of the trenching system, reference is made to FIG. 5 of the drawings, which shows the trenching machine digging a trench within the floor of a body of water. The rollers 74, 76 are shown positioned in an engaged position on the pipe 12. When the machine is placed on the pipe 12, hydraulic pressure is applied by means of the activation of valve 102 to the inner sides 99 of pistons 97 and 98 simultaneously to open both fore and aft sets of rollers 74, 76 respectively. Thus spaced apart the rollers may be positioned over the sides of the pipe 12. Valve 102 is then closed and hydraulic pressure is supplied by remote control 105 to open valve 95 and admit hydraulic pressure to lines 104. This in turn passes pressured fluid through bias pressure control valves 92, 93 into lines 89, 91 respectively to urge the cylinders 97, 98 and respective rollers 74, 76 inwardly.

The flange assemblies 37, connecting frame members 14 to the positioning arms 36, may be loosened to permit adjustment of the lateral spacing between jet heads 26. Such spacing is initially adjusted at the surface, but because of the conveniently operable flange connection 37, a diver can be utilized to adjust such lateral spacing underwater. In a similar manner, the flange assembly 34 positioned between positioning arms 36 and jet heads 26 is arranged so that tilting adjustment of the jet heads may be conveniently made underwater by a diver.

One or more divers are used to position the apparatus on the pipeline to begin the trenching operation. The trenching machine is weighted by admitting water to tank 21 until it will cause the machine to sink onto its operable position on the pipe 12. The diver then determines if the machine is properly weighted on the pipe and in the event the weight is not proper, communicates this to the surface whereupon the remote control 50 is operated to raise or lower the float valve 57 in the tank 21. As shown in FIG. 8, if the valve 57 were lowered in tank 21 to the extent that float 54 rises to its horizontal position with respect to the valve 57, the valve 57 opens and air is admitted through line 61 into the upper part of the tank 21 through tube 58.

Air is thus admitted under a pressure sufficient to displace water from the tank through any of the ports or openings in the tank 21. When the water level is dropped to the extent depicted in FIG. 7, the valve 57 is closed and the weight of the tank will remain fixed unless the float assembly is raised or lowered on the tube 49 by means of remotely controlled reversible motor 52. The weight of the apparatus, i.e., the tank 21 in combination with the displacement of the frame and associated apparatus, rests upon the pipe 12 through the fore and aft rollers 62, 63. A valve 68 on each of the biasing cylinders 67 associated with rollers 62, 63 is adjustable to permit a limited predetermined force to be supported by the rollers. The diver sets the machine on the top pressure rollers 62, 63 and adjusts the pressure on cylinders 67 by means of valves 68 until the fore and aft drive rollers concave groove 120 is centered on the side of the pipe 12. The valves 68 are also used to level the longitudinal pitch of the machine on the pipe. The rollers then act as a shock absorber as the trenching machine moves on the pipe. A balance of forces between the weight tank 21 and rollers 62, 63 maintains the machine in a balanced way on the pipe to facilitate its stable movement thereon. If the machine weighs 600 lbs. in water because of the amount of water admitted to tank 21, then each of the rollers might be set to support 300 lbs. if the machine were asymmetrically weighted. In any event, the rollers are adjusted to level and balance the machine's movement on the pipe. With weight being carried between the top rollers and the pipe of say 300 lbs., if the side drive rollers should open as the drive rollers pass over an obstruction, the forward top roller, which is mounted forward of the drive rollers, would already be over the obstruction and its concave groove being forced onto the contour of the pipe 12 acts as a stabilizing lateral holding force.

With the machine now positioned for operation on the pipe, water under pressure is supplied to the jet heads 26 which oscillate in a horizontal plane to excavate earth material from in front of the heads 26. Air supplied to educator tubes 18 causes the excavated material to be carried away from the trench site. Hydraulic power supplied to torque motors 107, 108 causes the fore and aft rollers to rotate and thereby drive the rollers along the sidewalls of the pipe. A balance is also created between the torquing force applied to the rollers 74, 76 by means of the drive motors and the biasing force applied to the rollers 74, 76 by the adjustable biasing system. This balance is arranged so that enough traction is provided to move the machine on the pipe and at the same time not damge the dielectric insulative coating on the pipe. If it were desired to have one ton of drawbar pull on each set of rollers, then 1000 lbs. of tractive pressure would be arranged on each roller by balancing between roller pressure and torque force.

In a trenching operation, it may be necessary to entrench the pipeline to a depth of say nine feet. In such event it is necessary with this machine to only run the machine back and forth on the pipe wherein the trench is deepened by successive passes, each cutting a somewhat smaller trench.

Another feature of maintaining equilibrium of the apparatus on the pipe involves the use of thrusters 70 to provide lateral roll control. A roll detector 80 provides a remote x-y readout of the vertical disposition of the machine at remote readout 85. An operator at the remote location can then operate the thrusters 70 in either of both directions to move the tank 21 and thus the trenching machine into a veertical position.

As the machine surfaces and the hydrostatic pressure of the water becomes less, the air in the tank 21 will expand to expel eater from the tank 21. This will make the tank lighter and tend to lift the tank and machine to the surface. If a diver is working on the machine and the machine should rise to the surface, the diver could become entangled in the apparatus and suffer harm. In the present system, as the water is displaced from tank 21, float 54 drops and dual valve 57 opens the vent line 45 into communication with line 58. This vents air from the tank and allows water to enter until the weight of the tank reaches its predetermined control level. Should this apparatus fail for any reason and the tank should tip, as might happen if the machine were to start to rise to the surface, the tilted level of water in tank 21 would open one or the other of vent lines 47, 48 to the air in tank 21 thus venting the air from the tank to admit more water through bottom openings and cause the system to gain weight and right itself.

The disclosure presented herein has shown the trenching system for use in laying a pipeline. It is readily apparent that other elongated line members such as cables or the like could also be entrenched by such a system.

While particular embodiments of the present invention have been shown and described, it is apparent that changes and modifications may be made without departing from this invention in its broader aspects; and therefore, the aim in the appended claims is to cover all such changes and modifications as fall within the true spirit of this invention.

I claim:

1. An underwater trenching apparatus for burying a line member such as a pipeline, beneath the bottom of a body of water, comprising:

(a) a frame for positioning on the line member to be buried beneath the bottom;

(b) means supported by said frame for excavating a trench in the bottom beneath said frame;

(c) a pair of line member engaging rollers supported by said frame and arranged to engage said line member on directly opposite face portions thereof;

(d) variable force producing means for urging both of said rollers into gripping contact with said line member;

(e) flexible mounting means for said rollers for urging said rollers toward the line member so that said rollers can only move toward and away from the line member;

(f) wherein said rollers are comprised of a deformable material and have a longitudinally concave exposed face to provide mating contact between the outside surface of the roller and a circular line member; and (g) further including voids formed within the wall of said rollers to permit said roller wall to partially collapse into a shape conforming to the outer peripheral surface of the line member.

2. The apparatus of claim 1 wherein said rollers have upper and lower annular transverse slots extending from the outer peripheral surface of said rollers to a position inwardly thereof at least equal to the distance said voids are spaced inwardly of the outer peripheral surface.

3. The apparatus of claim 1 wherein said slots intersect said voids.

4. The apparatus of claim 1 wherein said voids are comprised of a plurality of pockets radially spaced from the longitudinal axis in upper and lower horizontal planes above and below the longitudinal concave portion and within the wall of the rollers.

5. An underwater trenching apparatus for burying a line member, such as a pipeline, beneath the bottom of a body of water comprising:

a frame for gripping the line member to be buried;

roller means mounted on said frame and arranged for driving contact with said line member to facilitate movement of said trenching apparatus along said line member and wherein said roller means and said frame support the underwater trenching apparatus on the line member;

means for maintaining the underwater trenching apparatus upright relative to and on engagement with the line member independent of the bottom of the body of water;

means mounted on said frame for digging a trench beneath the line member, said digging means being comprised of a pair of laterally spaced elongated digging members normally substantially vertically arranged to cut the side walls of the trench, the lateral spacing of such digging members determining the width of the trench to be dug;

means for selectively adjusting the lateral spacing of said elongated digging members; and means for selectively inclining such elongated digging members from the vertical to vary the slope of the side walls of the trench.

6. The apparatus of claim 5 wherein said elongated digging members are rotatable about a substantially vertical axis, and further including means for oscillating said digging members about such a substantially vertical axis while such apparatus is moving along the line member.

7. The apparatus of claim 5 wherein said roller means is comprised of two sets of rollers mounted fore and aft on said frame longitudinally spaced from one another on the line member to thereby provide support of the fore and aft ends of said frame on the line member;

means for driving said rollers to move said frame along said line member; and means for applying a constant biasing force to said rollers to urge said rollers at all times into contact with said line member, with said rollers are moving along said line members.

8. The apparatus of claim 7, and further including means for selectively adjusting the constant biasing on each of the fore and aft sets of rollers so that the biasing force may be varied between the fore and aft sets of rollers.

9. An underwater trenching apparatus for burying a line member, such as a pipeline, beneath a body of water comprising:

a frame for positioning over the line member to be buried;

roller means mounted on said frame and arranged for driving contact with said line member to facilitate movement of said trenching apparatus along said line member;

trench digging means mounted on said frame for digging a trench beneath said line member as said frame is moved along said line member;

motive means for driving said roller means along said line member;

means for constantly urging said roller means into contact with said line member, said roller means being constructed of a deformable material to accommodate their driving engagement with the line member; and cavity means within the walls of said roller means to further permit deformation of said roller means so that said roller means conform to the shape of said line member when urged into contact therewith.

10. The apparatus of claim 9 wherein said roller means is comprised of a set of rollers arranged to contact opposite sides of said line member, with each of said rollers in said set being an elongated circular member having a longitudinally concave outer surface on the wall of the roller, said cavity means being comprised of a series of voids arranged radially about the longitudinal axis of said roller.

11. The apparatus of claim 10 and further including horizontal annular slot means extending from the outer surface of the roller wall, inwardly at least to an intersection with said series of voids.

12. The apparatus of claim 11 wherein said voids are radially arranged in two planes respectively near the top and bottom of said outer concave surface.

13. The apparatus of claim 12 wherein said annular slot means is comprised of two annular horizontal slots extending from the outer surface of the roller wall, inwardly into intersection with said voids.

14. An underwater trenching apparatus for burying a line member typified by a pipeline beneath the bottom of a body of water comprising:

(a) a frame for releasably, rotatively at least partially encircling a line member to be buried beneath the bottom wherein said frame is supported on the line member by roller means, and is susceptible to rotation about the line member as an axis of rotation;

(b) trenching means supported by said frame for excavating a trench in the bottom beneath said frame, said trenching means operatively forming the trench at a location below the line member in part dependent on the rotation of said frame relative to the line member;

(c) sensor means on said frame for detecting rotation of said frame about the line member as an axis for the rotation, and wherein said sensor means forms an indication of deviation from a specific rotational position; and (d) underwater, laterally directed, thruster means operable to rotate said frame about the line member to restore said frame to the specified rotational position.

15. The apparatus of claim 14 wherein said thruster means is bidirectional in operation to provide rotation as necessary to restore the said frame to the specified rotational-position.

16. The apparatus of claim 14 wherein said frame is rotationally positioned and said thruster means comprises underwater fans directed transversely of the axis of the line member to rotate said frame.

17. The apparatus of claim 16 including similar first and second thruster fans located fore and aft of said frame.

18. The apparatus of claim 17 wherein said thruster fans comprise fans enclosed in shroud means of specified length having opposing open ends and wherein said shroud means has an axis transverse of the line member; and said shroud means is supported by said frame spaced from the line member to exert torque on said frame to restore said frame to the specified rotational position.

19. The apparatus of claim 14 wherein said sensor means forms a remote indication of detected rotation.

20. The apparatus of claim 14 wherein said trenching means is pendantly directed below the line member, and includes left and right trenching mechanisms placed in bracketed relationship to the line member, and said trenching means is rotationally positioned to bias trenching to the right or left side of the line member and said thruster means rotates said trenching means to locate the trench formed thereby at a specified location below the line member.

* * * * *